US012691974B2

(12) United States Patent
Reichert

(10) Patent No.: US 12,691,974 B2
(45) Date of Patent: Jul. 28, 2026

(54) HYDROFOILING BOARD

(71) Applicant: Beta Foils Corporation, Halifax (CA)

(72) Inventor: Todd Reichert, Halifax (CA)

(73) Assignee: Beta Foils Corporation, Halifax (CA)

( * ) Notice: Subject to any disclaimer, the term of this patent is extended or adjusted under 35 U.S.C. 154(b) by 855 days.

(21) Appl. No.: 18/101,871

(22) Filed: Jan. 26, 2023

(65) Prior Publication Data

US 2023/0242218 A1 Aug. 3, 2023

Related U.S. Application Data

(60) Provisional application No. 63/304,307, filed on Jan. 28, 2022.

(51) Int. Cl.

| | |
|---|---|
| ***B63B 1/24*** | (2020.01) |
| ***B63B 32/51*** | (2020.01) |
| ***B63B 32/60*** | (2020.01) |
| ***B63B 32/66*** | (2020.01) |

(52) U.S. Cl.

CPC ..... *B63B 1/242* (2013.01); *B63B 1/248* (2013.01); *B63B 32/51* (2020.02); *B63B 32/60* (2020.02); *B63B 32/66* (2020.02)

(58) Field of Classification Search

CPC ..... B63B 1/24; B63B 1/242; B63B 1/248; B63B 32/60; B63B 32/66; B63B 32/10; B63B 32/51

See application file for complete search history.

(56) References Cited

U.S. PATENT DOCUMENTS

| | | | | |
|---|---|---|---|---|
| 5,809,926 | A | 9/1998 | Kelsey | |
| D410,058 | S | 5/1999 | Friend | |
| 7,144,285 | B1 | 12/2006 | Hendricks | |
| 7,192,323 | B2 * | 3/2007 | Smith | B63B 39/06 114/140 |
| 7,232,355 | B2 | 6/2007 | Woolley | |
| 7,819,074 | B2 | 10/2010 | Chen | |
| 7,832,349 | B2 | 11/2010 | Dansie | |
| D711,485 | S | 8/2014 | Thompson | |
| 8,870,614 | B2 | 10/2014 | Railey | |
| 9,180,949 | B2 | 11/2015 | Hansen | |

(Continued)

FOREIGN PATENT DOCUMENTS

| | | | |
|---|---|---|---|
| DE | 102018215176 A1 * | 3/2020 | B63B 32/60 |
| WO | 2015093984 | 6/2015 | |

OTHER PUBLICATIONS

AXIS Foils, Wake Thief Original Edition, https://axisfoils.com/products/axis-foils-wake-thief-original-edition, Retreived Feb. 9, 2023.

(Continued)

*Primary Examiner* — Ajay Vasudeva

(74) *Attorney, Agent, or Firm* — Fitch, Even, Tabin & Flannery LLP

(57) ABSTRACT

A hydrofoiling watercraft including a board for supporting a user includes a plurality of masts extending downwardly to connect one or more hydrofoil wings to the board. Examples of the watercraft include a fuselage mounted to each mast wherein a forward portion of each fuselage extends toward a direction of travel for the watercraft. A hydrofoil wing is mounted to the forward portion of each fuselage. A tail wing may be mounted to a rearward portion of the respective fuselages.

17 Claims, 10 Drawing Sheets

(56) References Cited

U.S. PATENT DOCUMENTS

| | | | | |
|---|---|---|---|---|
| D781,382 | S | 3/2017 | Etcheparre | |
| 9,586,659 | B2 | 3/2017 | Langelaan | |
| D843,303 | S | 3/2019 | Leason | |
| D849,663 | S | 5/2019 | Hiss | |
| 10,279,873 | B2 | 5/2019 | Logosz | |
| 10,486,771 | B2 | 11/2019 | Tian | |
| D913,192 | S | 3/2021 | Peng | |
| 11,225,305 | B2 | 1/2022 | Lyon | |
| 11,345,449 | B2 * | 5/2022 | Sommerlatt | B63B 32/66 |
| 11,472,511 | B2 | 10/2022 | Mckee | |
| D969,052 | S | 11/2022 | Cruz Alonzo | |
| 11,485,457 | B1 | 11/2022 | Montague | |
| 11,535,343 | B2 * | 12/2022 | You | B63B 32/51 |
| 11,878,775 | B2 | 1/2024 | Montague | |
| 11,919,608 | B2 | 3/2024 | Montague | |
| D1,060,571 | S | 2/2025 | Reichert | |
| D1,073,834 | S | 5/2025 | Reichert | |
| 2007/0062428 | A1 | 3/2007 | Eveleth | |
| 2015/0104985 | A1 | 4/2015 | Langelaan | |
| 2021/0107603 | A1 | 4/2021 | Howard-Willis | |
| 2022/0380005 | A1 * | 12/2022 | Rosen | B63B 73/72 |
| 2023/0042907 | A1 * | 2/2023 | Valera Ruiz De La Sierra | B63B 1/242 |
| 2023/0242218 | A1 | 8/2023 | Reichert | |
| 2024/0149979 | A1 * | 5/2024 | Andrewartha | B63H 21/21 |

OTHER PUBLICATIONS

"My first Freefoil experience with BETA Foils" Jul. 9, 2023, site visited Mar. 23, 2024, YouTube.Com: https://youtu.be/WfJbF0xkUOY?si=YPvZ6hPa6H_xdqP2(Year: 2023).

* cited by examiner

HYDROFOILING BOARD

CROSS-REFERENCE TO RELATED APPLICATIONS

This application claims the benefit of U.S. Provisional Application No. 63/304,307 filed Jan. 28, 2022, which is incorporated herein by reference in its entirety.

FIELD

This disclosure relates to hydrofoiling boards and, in particular, to hydrofoiling boards designed for human-powered foiling.

BACKGROUND

A variety of human powered hydrofoil watercraft are known, which take advantage of hydrofoils to lift the watercraft out of the water, thereby reducing drag and allowing for greater speeds of propulsion at levels of effort achievable by the human rider. Such devices include pedal-powered devices such as disclosed in U.S. Published Application No. 2021/0107603; elliptical or stair-step devices such as disclosed in U.S. Pat. No. 9,180,949; and devices powered through a jumping motion such as disclosed in U.S. Pat. No. 7,819,074. A variety of powered hydrofoil devices have also been developed, in which an electric motor propels the craft at speeds necessary to fly above the water on a hydrofoil. As used herein, making a hydrofoiling watercraft "fly" is defined as the act of propelling the watercraft forward at a sufficient speed that the watercraft and rider rise or remain out of the water, while the hydrofoil remains submerged to support the watercraft.

Unpowered hydrofoil surfboards or stand-up hydrofoil paddle boards are known types of watercraft, often used to surf on a wave at foiling speeds. Riders have discovered that these devices can also be propelled on flat water, by using a pumping motion to propel the board at speeds sufficient to make the board "fly" for short periods of time. The surfboard is propelled forward utilizing a pumping motion from the rider, sometimes with additional thrust from a paddle. The technique is illustrated in FIG. 9, which shows a sequence of motions and board positions that a rider 950 can use to achieve a wave-like flying motion on the surfboard 900 by exerting force on the board 901, as shown in (a)-(e), from right to left in the figure. Starting with (a), the main hydrofoil 905 has a tendency to lift the nose of the board upward. Riders may encourage this lift by placing weight on their rearward leg 952. As illustrated in (b), the rider must counteract the lift of the hydrofoil 905 before it breaches the surface of the water. This is achieved by placing greater weight on their forward leg 954 to press downward on a forward portion of the board 901. In (c), the rider maintains a forward posture, causing the board to pitch downward. Once the board has pitched downward, the rider pumps the board with a jumping motion using both legs, to generate thrust and increase the forward speed of the board. As illustrated in (d), the rider must pitch the board upward before the board 901 contacts the surface of the water. In (e), the rider returns to the position illustrated in (a), allowing the surfboard 900 to pitch upwardly, trading forward speed for height above the water. Upward momentum of the rider's body, generated by the jumping motion in (c), allows the board to gain altitude above the surface of the water while the board 901 is pitched upward. In this manner, the riders use the strength in their legs to push the board downwardly and increase speed, or allow the board 901 to lift upwardly out of the water to a maximum flying height. This pumping motion of the rider's legs provides the energy needed to maintain the board at foiling speed.

To achieve foiling speeds, known unpowered hydrofoil surfboards are often launched using large bungee cords or by using a running start. Relatively high effort is needed to maintain the board's flight through the pumping action described above. Commercial product configurations have been developed to increase flying time for human-powered hydrofoiling boards. In one example, Axis Foils of Whangaparaoa, New Zealand sells a "Wake Thief Edition" of their PNG 1150 hydrofoil, which has a wingspan of 1150 mm and a chord of 180 mm, combined with a high aspect-ratio rear wing; short fuselage between the hydrofoil and rear wing; and a relatively rigid, short mast.

Even with specially selected components such as the Axis Foils product described above, riders on existing human-powered hydrofoil surfboards have only maintained foiling flight for periods of less than five minutes and typically much closer to one minute. The power requirements needed to maintain flight on such boards are largely achieved at anaerobic levels of effort for the average human, i.e., relying upon the human anaerobic energy system. However, humans can only maintain anaerobic efforts for a maximum of about 2.5 minutes.

FIG. 10 is a diagram 1000 illustrating the relationship between maximum sustainable power output and duration in minutes for healthy humans as shown on the line labeled 1010. A separate line 1020 shows the curve for highly trained athletes. A human's ability to produce power for an extended length of time dramatically increases if the required power can be reduced below that person's anaerobic threshold, i.e., the knee in the curve approximately located at the dashed line 1034. In contrast, the power a human can sustain for 30 minutes, as an aerobic effort, is shown at the dashed line 1036. If it is possible on current boards to fly 2.5 minutes, a reduction of approximately 25% in the required power would allow significantly longer flights, a flying experience that might warrant the purchase of a human-powered hydrofoiling board.

As illustrated in FIG. 10, at periods of two minutes and less, humans are generally capable of outputting 400 W or more of power using short-term energy stored in the muscles. In highly trained athletes, the power achieved in this "anaerobic zone" can be increased as shown on the curve labeled 1020, but the time at this power remains a physical limit. Indeed, the best riders can only fly existing human-powered hydrofoil boards for about 5 minutes before becoming exhausted. This is a very short-lived flying experience that, for most people, would not warrant the purchase of a human-powered hydrofoiling board. One challenge in human-powered hydrofoiling board design is to reduce the power requirement so that the human-powered hydrofoiling board can be operated at aerobic levels of exertion, where the body is burning largely fats and proteins, thereby allowing longer flights. As illustrated in FIG. 10, for efforts of up to thirty minutes (at dashed line 1036), aerobic efforts correspond to power levels between 200-300 W for healthy humans.

DETAILED DESCRIPTION

Figure 1:
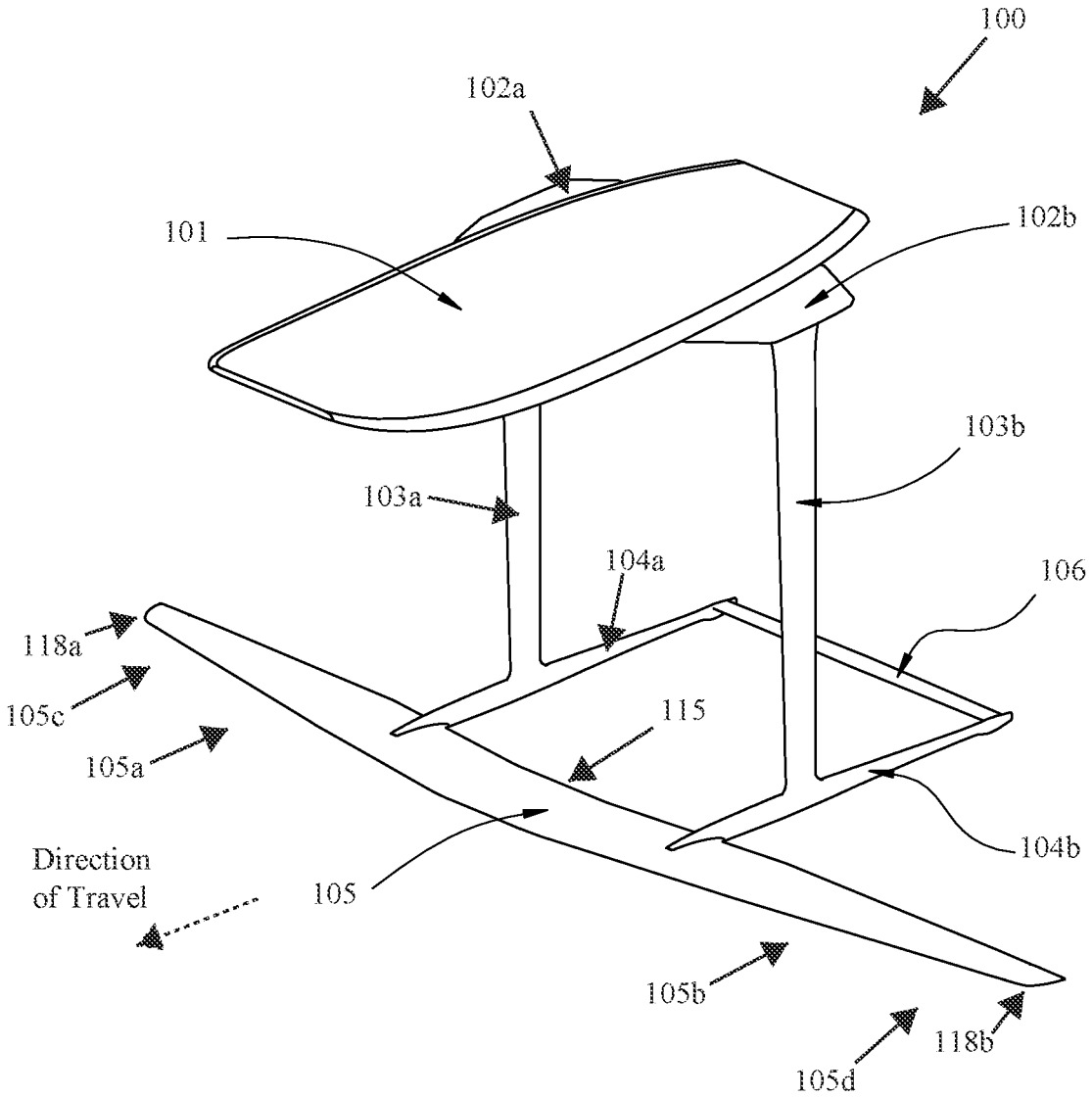
FIG. 1 is a top perspective view of an a hydrofoiling surfboard.

The disclosed invention is a hydrofoil controlled by a rider using the rider's weight-shift and propelled through effort of the rider. Through theoretical analysis and experimentation, the inventor has discovered two variables (wing span and structural stiffness) that increases efficiency of human-powered hydrofoil boards to allow riders at aerobic levels of exertion to dramatically improve their riding experience. While increasing human-powered hydrofoil board wingspan reduces the required power to maintain longer foiling flights, no one has figured out how to make such a large span human-powered hydrofoil board controllable or stiff enough for efficient power delivery. Devices with the features described herein make this possible, which allows development of the human-powered hydrofoil board as a useful product.

The hydrofoil and mast design disclosed herein provides a more efficient hydrofoil that may also have applications in other hydrofoil sports. The design disclosed herein substantially reduces the drag of the foil, which would allow surfing on smaller waves, and wing surfing, kitesurfing and downwind paddleboarding in lower wind conditions.

In the designs disclosed herein, substantial rigidity along the length of the board, down the masts, and along the fuselage provides efficient propulsion. Flexibility along that load path that allows the hydrofoil wing, or parts thereof, to pitch relative to the board could cause a pitching motion in the wing that is opposite to the pitching that provides efficient thrust. In addition, with large hydrofoil wingspans of the sort described herein, rigidity along the length of the wing provides efficient transfer of the propulsive force from the foil to the water, and for improved controllability of the design. The use of multiple masts to connect the hydrofoil to the board, as shown in the drawings and discussed below, substantially increases the rigidity along the length of the wing. Although known designs have included springs or other compliant features, preferred embodiments of the invention are substantially rigid. These preferred designs offer a highly efficient motion and eliminate moving parts, which are frequently a point of failure and complexity in known designs. In some examples, however, a spring or other compliant element may be used to cause the wing or tail to pitch in a direction that increases, instead of decreases, the efficiency of propulsion.

An example of a human powered hydrofoil board is illustrated in FIGS. 1-4, in which the following features are called out.

100: human-powered hydrofoil board.

101: board, preferably comprised of a floatable material. In preferred embodiments, the board includes a foam core enclosed in a woven carbon fiber shell. This type of structure provides extreme strength and can be shaped to optimize hydrodynamic drag. Other resin impregnated materials could be used for the shell including fiberglass or carbon fiber impregnated plastic.

110: top surface of the board 101.

111: bottom surface of the board 101.

102*a*: right side of the board 101, which may include the winglet 102*a* extending outwardly from a flotation portion 101 of the board.

102*b*: left side of the board 101, which may include the winglet 102*b* extending outwardly from a flotation portion 101 of the board. In some examples the right winglet 102*a* and left winglet 102*b* may be part of a wing structure or other support that underlies the board 101. For example, if the board 101 is fabricated from foam or a hollow shell, a support structure extending between right mast 103*a* and left mast 103*b* would provide rigidity and serve to support the board 101.

103*a* and 103*b*: right side and left side masts, respectively extending from the right side and left side of the board. In preferred embodiments, the right side mast 103*a* and left side mast 103*b* are both rigidly connected to the respective right side 102*a* and left side 102*b* of the board.

104*a* and 104*b*: right side and left side fuselages, mounted to the rights side mast 103*a* and left side mast 103*b*, respectively. In preferred embodiments, the right side fuselage 104*a* and left side fuselage 104*b* are both rigidly connected to the respective right side mast 103*a* and left side mast 103*b*.

Figure 2:
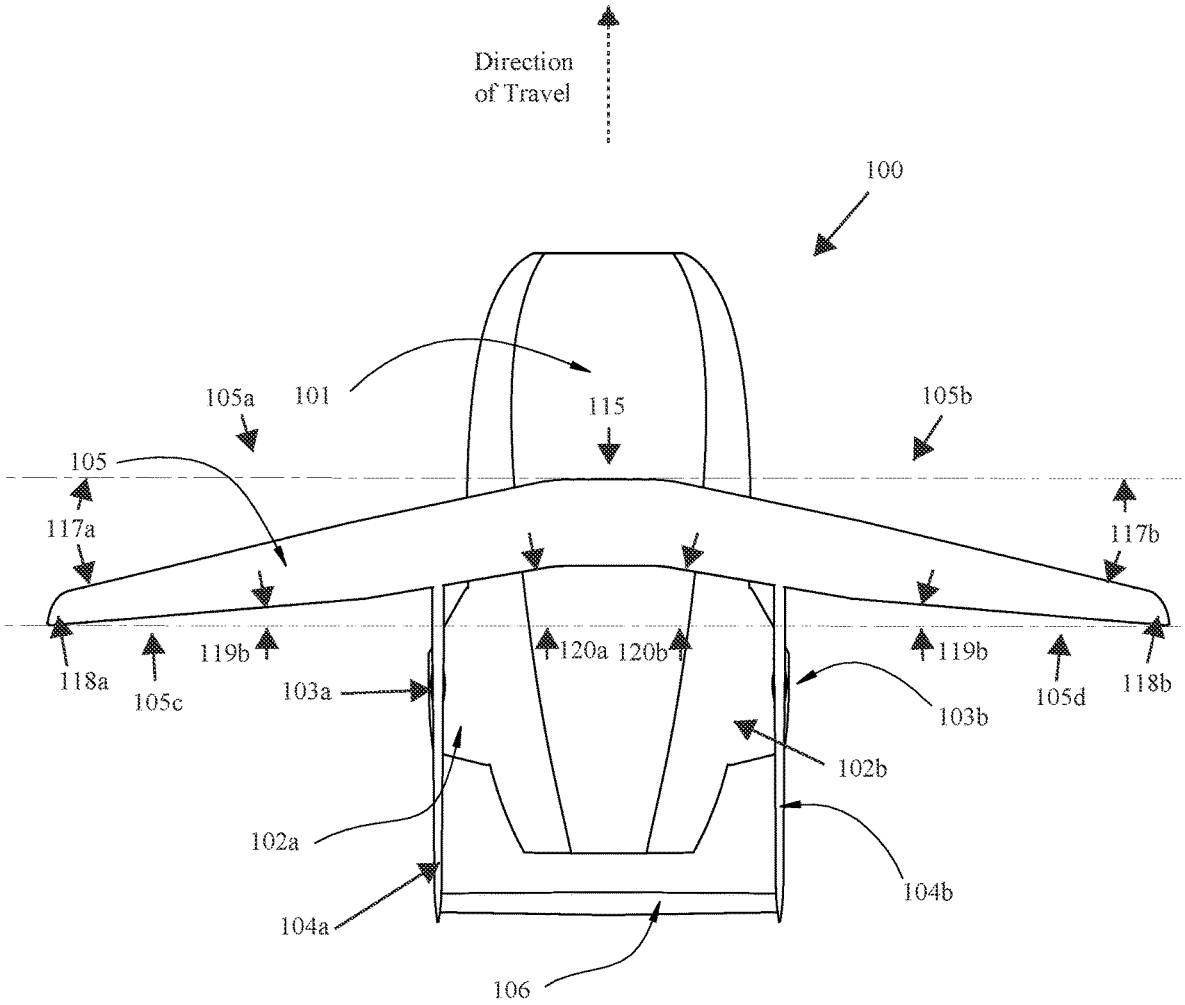
FIG. 2 is a bottom view of the hydrofoiling surfboard of FIG. 1.
Figure 4:
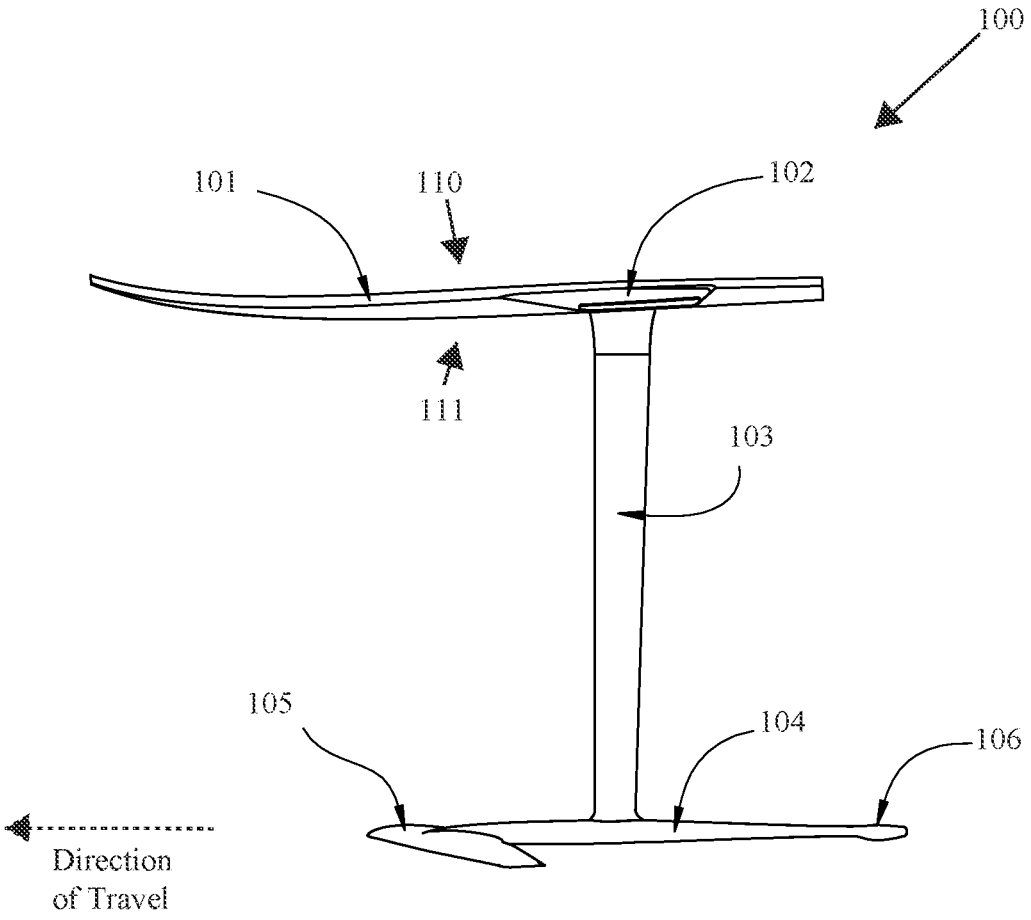
FIG. 4 is a side view of the hydrofoiling surfboard of FIG. 1.

105: main hydrofoil wing, designed to provide lift when the human-powered hydrofoil board moves through the water in a direction of travel, shown by the dashed arrow in FIGS. 1, 2, and 4. The main hydrofoil wing 105, fuselages 104, and masts 103 are preferably fabricated using a carbon fiber or other resin impregnated material that provides an adequate strength to weight ratio and can be shaped to optimize hydrodynamic drag. Other materials could also be used as would be known to persons having ordinary skill in the art. In preferred embodiments, the hydrofoil 105 is rigidly connected to the respective right side fuselage 104*a* and left side fuselage 104*b*.

Figure 3:
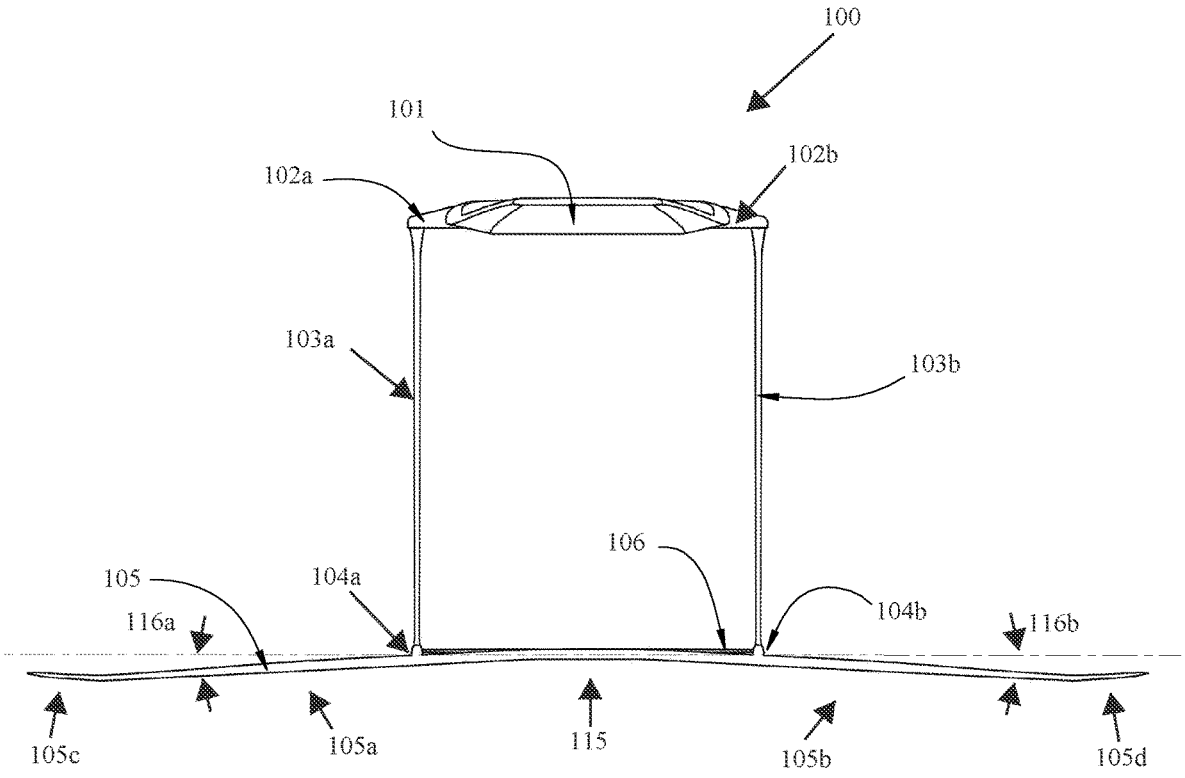
FIG. 3 is a front view of the hydrofoiling surfboard of FIG. 1.

105*a* and 105*b*: right side and left side portions, respectively, of the main hydrofoil wing 105. As illustrated in FIG. 3, the right-side portion 105*a* and left-side portion 105*b* preferably angle downwardly away from the board.

105*c* and 105*d*: right side and left side wingtip portions, respectively, of the main hydrofoil wing. The right side wingtip portion 105*c* and left side wingtip portion 105*d* extend outward from the right side portion 105*a* and left side portion 105*b*, respectively. The wingtip portions 105*c* and 105*d* may angle back and upwardly from the outboard part of the main hydrofoil wing 105 as shown in FIG. 3. Having wingtips 105*c* and 105*d* that angle upwardly (as shown in the drawing) may improve stability in the event the wingtip breaches the surface of the water, for example while the rider is performing a deep rolling turn. An upward angle of the wingtip portions 105*c* and 105*d* advantageously prevents air from ventilating downwards along the rest of the wing, which would cause the wing to lose lift during a surface breach. The upward-angled wingtip portions 105*c* and 105*d* allow for the use of substantially larger hydrofoil wingspans. Such large wingspans make it more probable that a wingtip will breach as the hydrofoil board 100 rolls. The illustrated design with upward angled wingtip portions 105*c* and 105*d* makes such a breach more benign so that even if a wingtip breaches the surface of the water the rider can maintain control of the board and flight above the water on the hydrofoil wing 105.

106: tail wing, which is preferably designed to provide stability in the pitching direction. The presence of a tail wing effectively dampens or resists forces that would otherwise tend to cause the board to pitch forward or back.

115: middle portion of the main hydrofoil wing 105.

116*a* and 116*b*: downward angle of the right side portion 105*a* and left side portion 105*b*, respectively, of the main hydrofoil wing 105. The downward angles 116 are illustrated relative to a horizontal dashed line in FIG. 3.

117*a* and 117*b*: leading edge sweep angle of the right side portion 105*a* and left side portion 105*b*, respectively, of the main hydrofoil wing 105. The leading edge sweep angles 117 are illustrated relative to a horizontal dashed line in FIG. 2.

118*a* and 118*b*: right side and left side wingtips, respectively, of the main hydrofoil wing 105.

119*a* and 119*b*: outer trailing edge sweep angle of the right side portion 105*a* and left side portion 105*b*, respectively, of the main hydrofoil wing 105. The outer trailing edge sweep angles 117 are illustrated relative to a horizontal dashed line in FIG. 2.

120*a* and 120*b*: inner trailing edge sweep angle of the right side portion 105*a* and left side portion 105*b*, respectively, of the main hydrofoil wing 105. The inner trailing edge sweep angles 117 are illustrated relative to a horizontal dashed line in FIG. 2.

Figure 5:
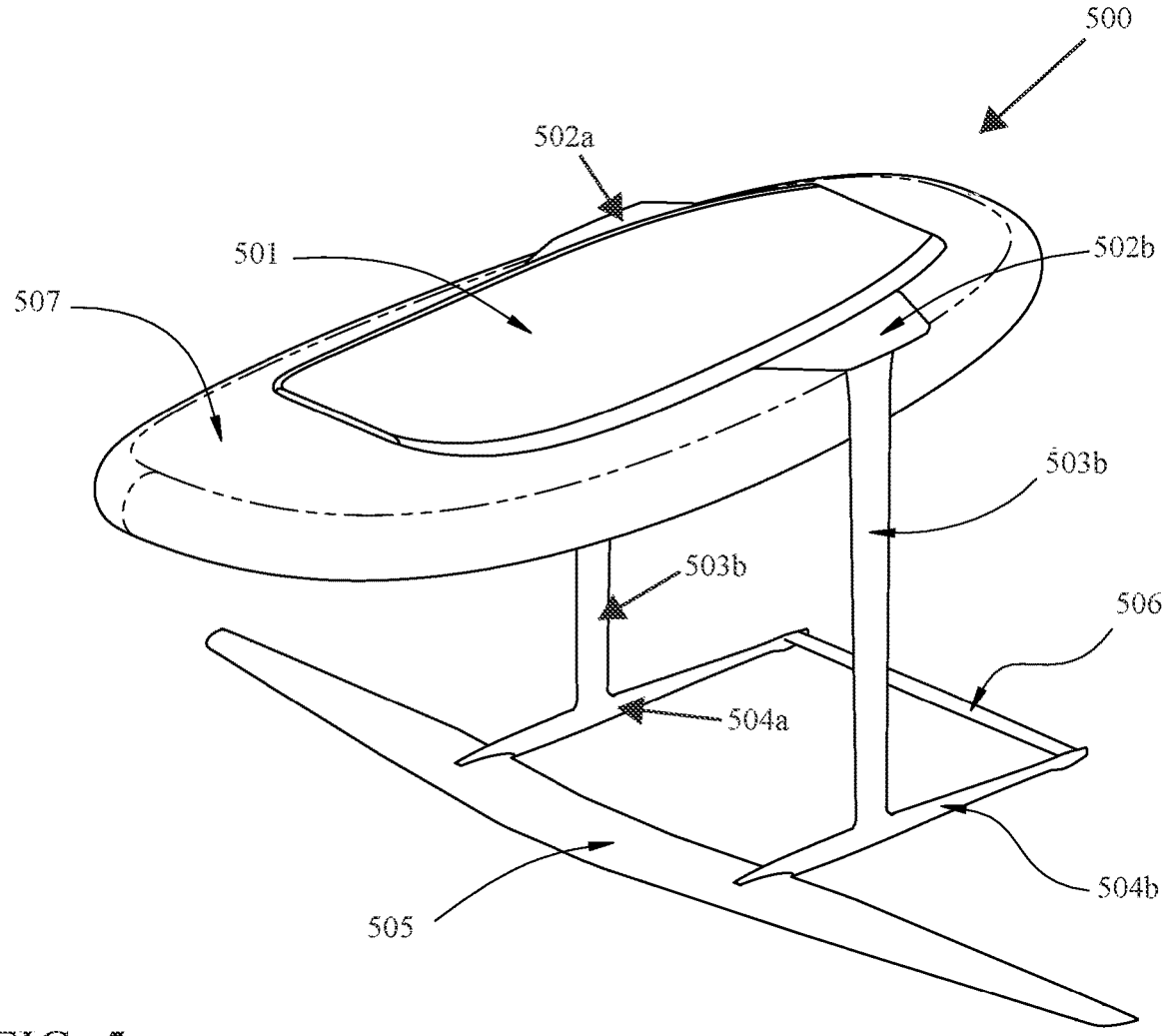
FIG. 5 is a top perspective view of a hydrofoiling surfboard.

Another example of a human powered hydrofoil board is illustrated in FIG. 5, in which the following features are called out. The example illustrated in FIG. 5 may include features described above with respect to FIGS. 1-4, in addition to features described below.

500: human-powered hydrofoil board.

501: board, preferably comprised of a floatable material and which may have features as illustrated in FIGS. 1-4.

502*a*: right side of the board 501, which may include the winglet 502*a* extending outwardly from a flotation portion 501 of the board.

502*b*: left side of the board 501, which may include the winglet 502*b* extending outwardly from a flotation portion 501 of the board.

503*a* and 503*b*: right side and left side masts, respectively extending from the right side and left side of the board.

504*a* and 504*b*: right side and left side fuselages, mounted to the rights side mast 503*a* and left side mast 503*b*, respectively.

505: main hydrofoil wing, designed to provide lift when the human-powered hydrofoil board moves through the water in a direction of travel. The hydrofoil wing shown in FIG. 5 preferably includes the features described above with respect to the hydrofoil wing 105 illustrated in FIGS. 1-4.

506: tail wing

507: removable flotation portion surrounding the board 501 to provide supplemental flotation and increase stability of the board 501 by increasing the displacement of the board 501 when a rider stands on the board 501 and/or the flotation portion 507. The flotation portion 507 may be inflatable with a gas such as air, making it easily added to the board when a beginner rider is learning to use the human-powered hydrofoil board. For example, the flotation portion 507 may make it easier to take off when towed behind a boat. The flotation portion 507 may also provide cushioning if the rider bumps into the board or if the board bumps into another watercraft or a fixed structure such as a dock. Board 500 with added-flotation portion 507 is also well-suited for use as a stand-up paddle board. Since the inflated flotation portion 507 is peripheral to the rigid board 501 that supports the rider, the flotation portion 507 may be designed with the assumption that it will not directly carry the rider and thus the flotation portion 507 can be made from lighter materials than typical inflatable stand-up paddle boards. The flotation portion 507 may be designed to attach to the bottom of the board 501. The rigid board 501 should still firmly connect to the hydrofoil in the way shown in FIGS. 1-4 and described above, so that flexibility in the inflatable board does not affect the control qualities or propulsive efficiency of the system.

Figure 6:
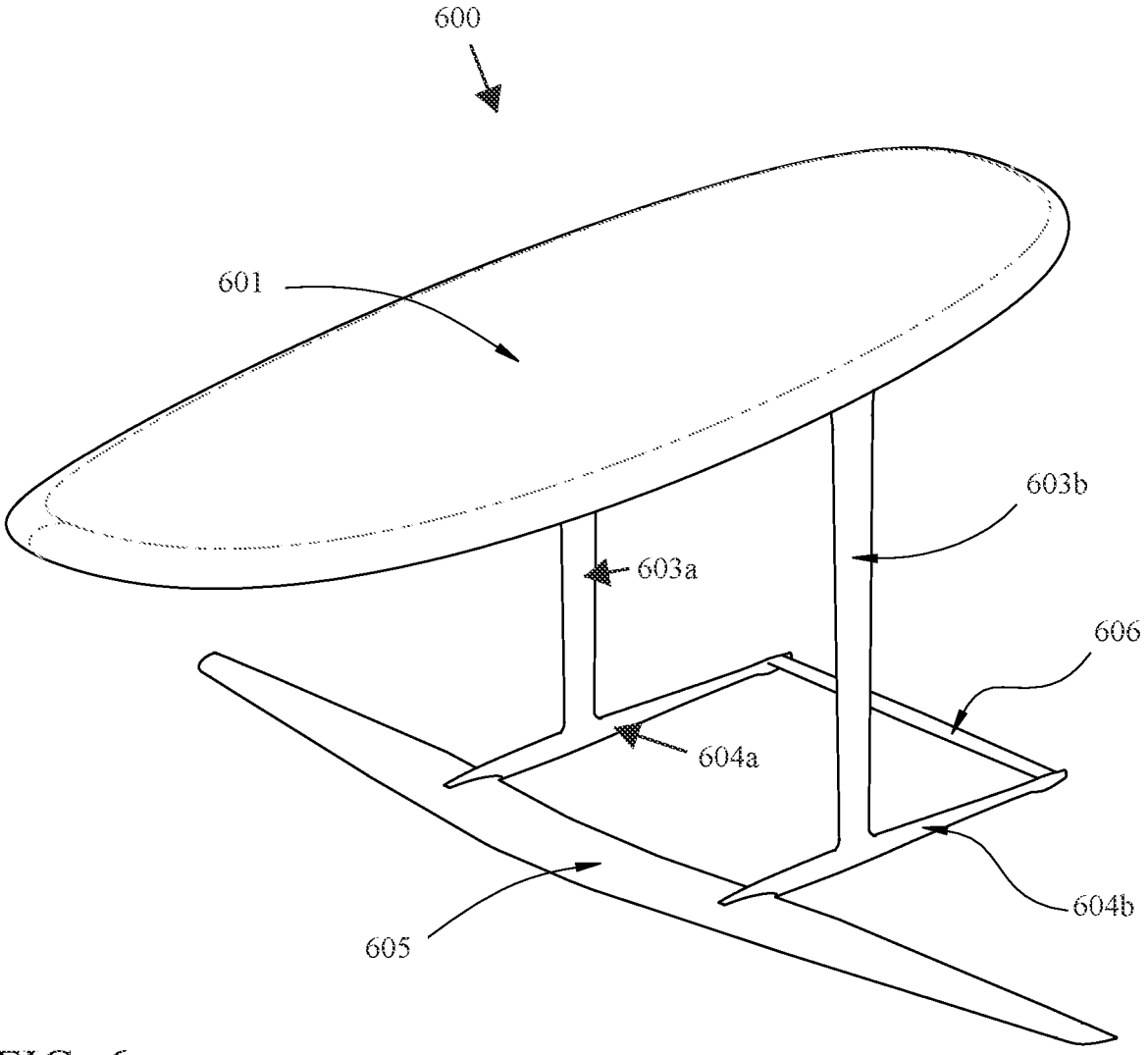
FIG. 6 is a top perspective view of a hydrofoiling surfboard.

A stand-up paddle board example of a human powered hydrofoil board is illustrated in FIG. 6. The example illustrated in FIG. 6 may include features described above with respect to FIGS. 1-5, in addition to features described below. Stand-up paddle board hydrofoils user larger boards that allow the user to stand up, floating on the board when it is not in motion. With the use of the paddle, they can start from deep water and generate enough speed to begin or continue flying with a hybrid pumping/paddling motion. The use of the mast and hydrofoil design described in FIGS. 1-5 and discussed above, attached to a larger board, enable use of a more efficient hydrofoil design with a stand-up paddle board foil, unlocking much longer endurances in that sport.

600: human-powered hydrofoil board

601: board, preferably comprised of a floatable material. As shown in this example, the board 601 may be substantially larger and longer than the board 101 illustrated in FIGS. 1-4. A longer, wider board as shown in FIG. 6 may be preferable for applications such as stand-up paddle-boarding, in which the human-powered hydrofoil board may be propelled primarily by a rider using a paddle. In the stand-up paddle board application, the rider may use the paddle to develop initial speed to get the board flying on the hydrofoil, and may use either the paddle or a pumping motion of the board to maintain speed of the board to keep it in flight. The longer, wider board as shown in FIG. 6 provides substantially greater floatation and stability to facilitate paddling of the board. This added stability may facilitate starting and stopping in deep water without the assist of a tow boat or other device.

603*a* and 603*b*: right side and left side masts, respectively extending downwardly from a bottom surface of the board 601.

604*a* and 604*b*: right side and left side fuselages, mounted to the rights side mast 603*a* and left side mast 603*b*, respectively.

605: main hydrofoil wing, designed to provide lift when the human-powered hydrofoil board moves through the water in a direction of travel. The hydrofoil wing shown in FIG. 6 preferably includes the features described above with respect to the hydrofoil wing 105 illustrated in FIGS. 1-4.

Figure 7:
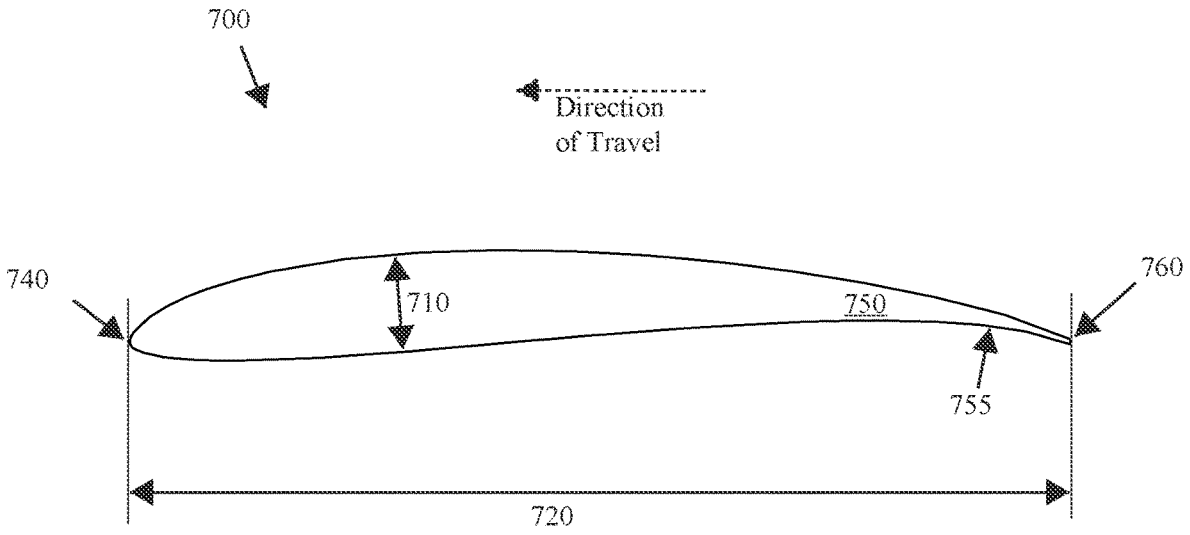
FIG. 7 is a cross-sectional view of a hydrofoil.

In FIG. 7, a cross-sectional profile of a preferred main hydrofoil wing (e.g., 105,505, 605, or 805) is shown. The hydrofoil is preferably optimized for flapping propulsion, to facilitate the pumping propulsion of the human-powered hydrofoil board (e.g., 100,500,600, or 800). The cross-sectional profile is preferably designed using an optimization scheme combined with flapping-wing theory and kinematic analysis of the pumping motion to produce an exceptional wing cross section. Cross-section 700 has a thickness between 10% and 13% of the chord length 720. A leading edge 740 has a rounded but relatively sharp curvature. A rearward section 750 includes a moderate downward curve, creating a concave lower surface 755 and a downward-sloped trailing edge 760.

Figure 8:
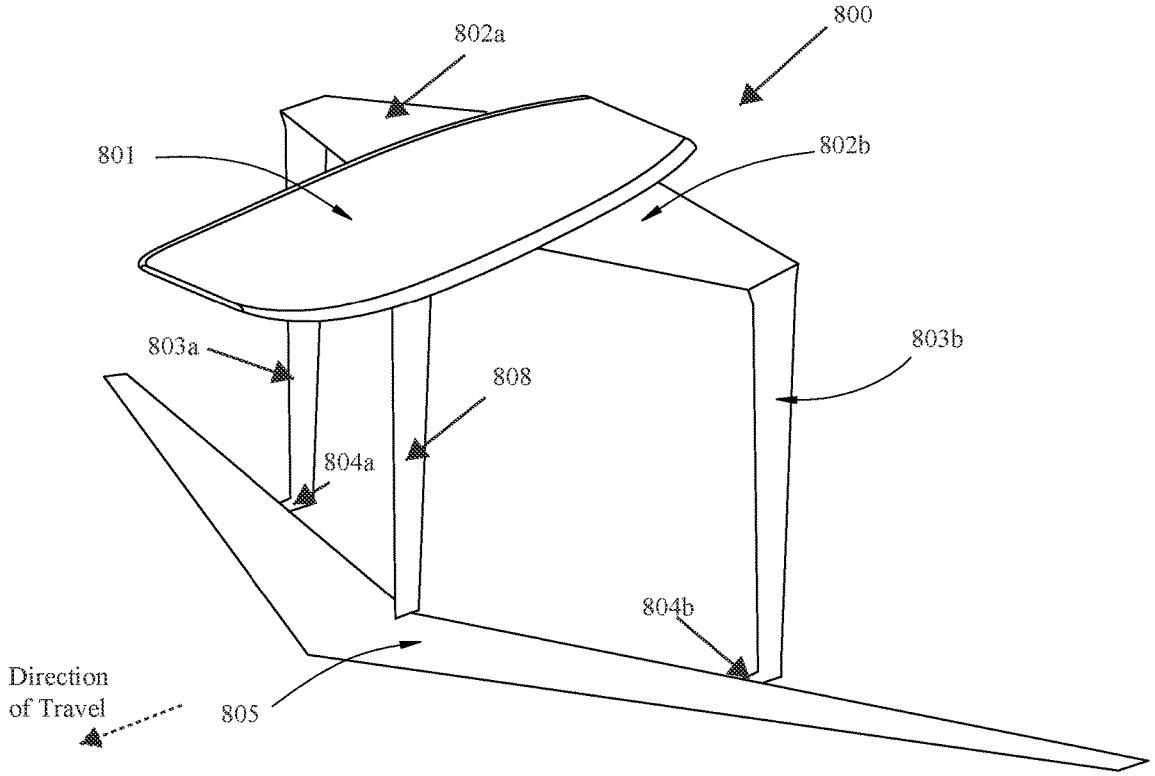
FIG. 8 is a top perspective view of a hydrofoiling surfboard.
Figure 9:
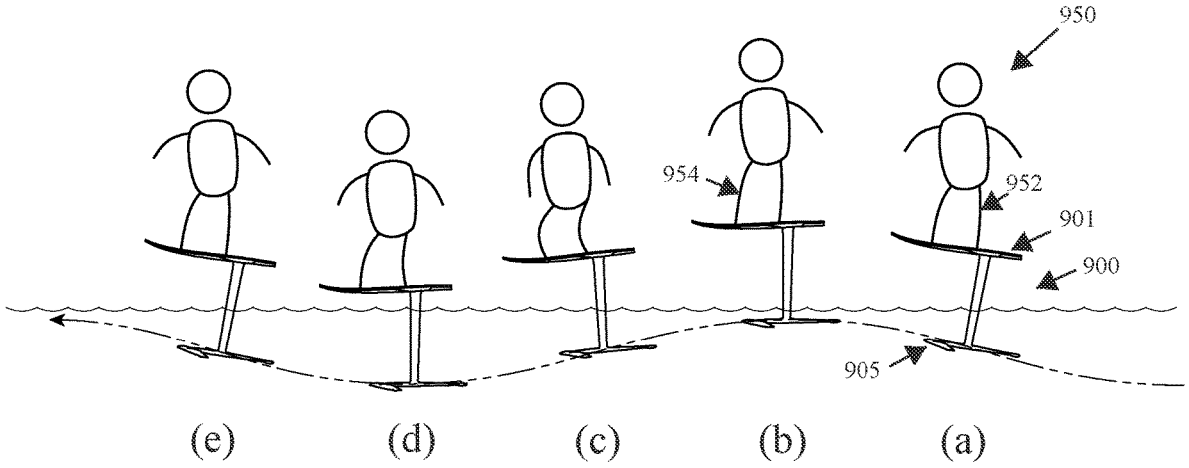
FIG. 9 includes a series of images (a)-(e) showing a hydrofoiling surfboard in use by a rider.
Figure 10:
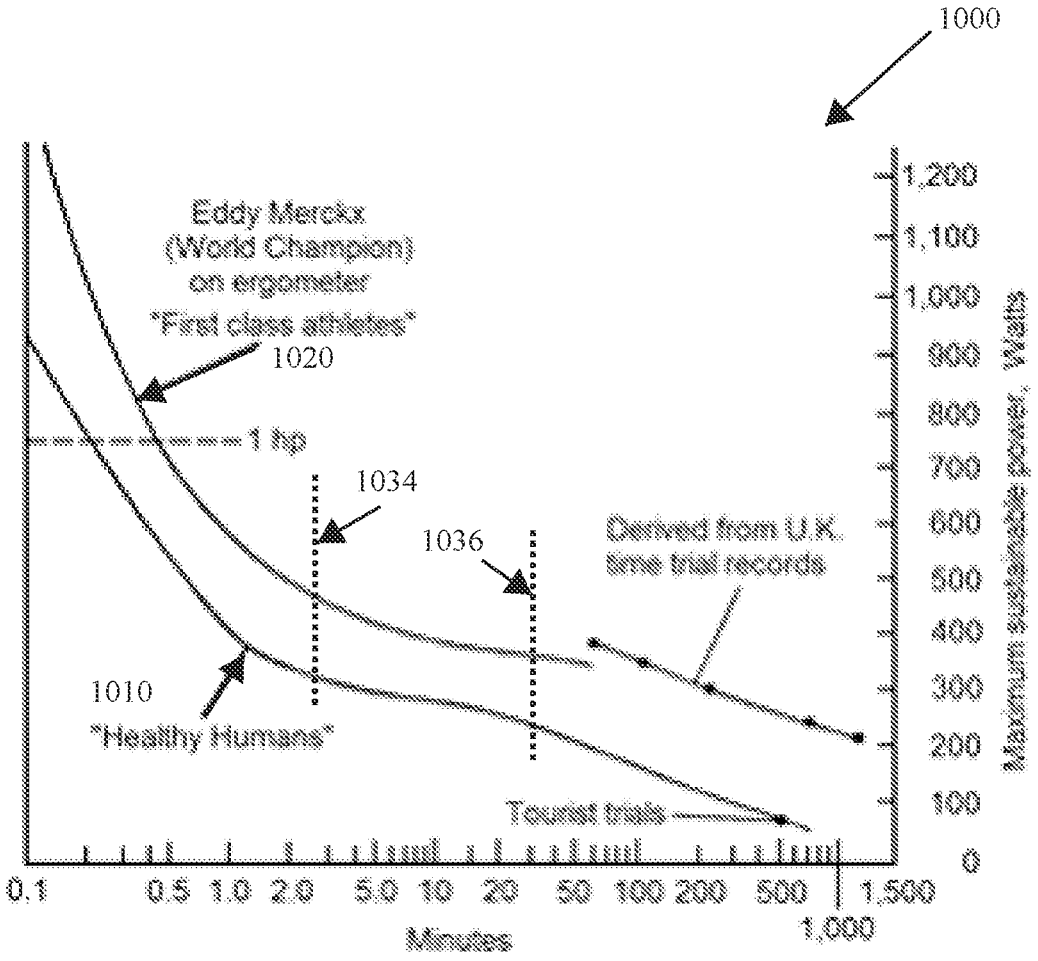
FIG. 10 is a chart illustrating sustainable power at varying lengths of time, for humans of varying aerobic training.

A three-masted example of a human powered hydrofoil board is illustrated in FIG. 8, which provides even greater efficiency for long distance foil boarding. The example illustrated in FIG. 8 may include features described above with respect to FIGS. 1-6, in addition to features described below. The invention is not limited to three masts. A 3, 4 or 5 mast design can provide a rigid hydrofoil with extremely long spans in the range of 3 meters. Although impractical for general use on small bodies of water, long distance touring may benefit from this approach.

The example illustrated in FIG. 8 is also tailless. The pitch stability requirements of hydrofoil boards are generally understood to make a tailless design (sometimes called a flying wing in aircraft design) less efficient. However, with the extra wingspan of the illustrated 3 mast design, with aggressively swept hydrofoil wing, a tailless design may be more efficient than the design shown in FIGS. 1-4. The use of a third mast advantageously increases stiffness in the wing, particularly for substantially large wingspans. In preferred embodiments of the example illustrated in FIG. 8, the hydrofoil wingspan is approximately 3 meters. Examples illustrated in FIGS. 1-6 are designed to be stable in pitch by including a tail wing, which provides balancing forces to maintain optimal pitch of the board without requiring the rider to exert extra balancing effort. In a flying wing (tailless) design, stability is accomplished by using sweep and washout (where the hydrofoil is pitched down near the wingtips). Designs using sweep and washout to achieve pitch stability are generally known to create more drag than designs using a tail wing. But with extremely large spans such as that shown in FIG. 8, a tailless design may have similar or less drag, while also requiring fewer parts. Although the example illustrated in FIG. 8 incorporates a tailless design, a human powered hydrofoil board with a 3, 4, or 5 mast design could also include a tail wing of the sort illustrated in FIGS. 1-6, attached either to fuselages 804 extending rearwardly or attached through similar structures to the wing 805. In FIG. 8, the following features are called out.

800: human-powered hydrofoil board.

801: board, preferably comprised of a floatable material and which may have features as illustrated in FIGS. 1-4.

802*a*: right side of the board 101, which may include the winglet 802*a* extending outwardly from a flotation portion 101 of the board.

802*b*: left side of the board 101, which may include the winglet 802*b* extending outwardly from a flotation portion 101 of the board.

803*a* and 803*b*: right side and left side masts, respectively extending downwardly from a bottom surface of winglets 802*a* and 802*b* of the board 801.

804*a* and 804*b*: right side and left side fuselages, extending forwardly from the rights side mast 803*a* and left side mast 803*b*, respectively. Some examples will omit the fuselages 804 in favor of mounting the hydrofoil wing 805 directly to a vertical portion of the masts 804.

805: main hydrofoil wing, designed to provide lift when the human-powered hydrofoil board moves through the water in a direction of travel (illustrated by the dashed arrow in FIG. 8). The hydrofoil wing 805 has a substantially larger wingspan than the hydrofoil wing 105 illustrated in FIGS. 1-4, which is made possible through the use of larger winglets 802 (relative to winglets 102) extending outwardly from the board 801. The hydrofoil wing 805 is aggressively swept rearwardly to provide pitch stability within the single wing illustrated, without the use of a separate tail wing (e.g., 106). Portions of the hydrofoil wing 805 may extend outwardly from the respective outermost masts, e.g., right side mast 803*a* and left side mast 803*b*. In preferred embodiments, the main hydrofoil wing 805 is rigidly mounted to the center mast 808, the right side fuselage 804*a*, and the left side fuselage 804*b*. Although not illustrated, the wing 805 may include washout such that portions of the hydrofoil are pitched downwardly near the wingtips. The hydrofoil wing shown in FIG. 8 preferably includes the features described above with respect to the hydrofoil wing 805 illustrated in FIGS. 1-4.

808: center mast positioned to provides additional support fore and aft of the outboard masts 803, which are positioned rearwardly relative to the center mast 808. The three-masted design illustrated in FIG. 8 provides additional rigidity to the more aggressively swept hydrofoil wing 805.

The examples of the human powered hydrofoiling board illustrated herein provide numerous advantages over known designs. Wing area has been found to be important to long endurance. The illustrated examples provide substantially larger wingspan than known devices. Preferred examples shown in FIGS. 1-6 include a 1.6-2.4 m wingspan. This preferred wingspan is appropriate for riders weighing 120-240 lbs (54-108 kgs) to provide optimum lift relative to drag. The example illustrated in FIG. 8 may include an even larger wingspan of 2.2-3.5 m.

Two vertical masts (e.g., 103*a* and 103*b*): this makes the human-powered hydrofoil board much stiffer. Wing flexing severely hampers controllability and also results in severe power loss. The wingspan limit for a single-mast architecture is about 1.3 m. By providing two masts, the wing can be made longer. The masts themselves can also be made thinner to produce less mast drag, because the multiple mast structure requires each individual mast 103 to have less torsional rigidity.

Tail placed between the vertical struts: in some examples the tail wing 106 does not extend beyond the two fuselages 104*a* and 104*b*, making it easier for riders to start from a dock or beach without contacting the fragile tail against a dock, another watercraft, or their legs. The distance between the fuselages 104*a* and 104*b* is optimized for good dock-starting ergonomics, an appropriate tail size and span and structural stiffness of the main wing.

The tail size should be finely tuned so that the natural frequency of the foil's pitching motion is the same as the pumping frequency. In preferred examples, the tail foil makes the board feel a like a trampoline, in that it provides "springiness" when the riders pump their legs against the board.

The examples shown in FIGS. 1-4 and 8 include a small board relative to known watercraft. A small board reduces energy required to pump by reducing the pitching inertia of the board (e.g., 101, 801). The board is designed with significant thickness in the middle for stiffness and is thin at the nose to reduce pitching inertia.

The use of winglets on the board (e.g., 102, 502, 802) is also unique relative to known watercraft designs. Large span wings of the type illustrated in the preferred examples require the ability to move the back foot side to side a large amount, to increase the rider's leverage when steering the board. In addition to providing outboard support for the hydrofoil wing (e.g., 105, 805), the winglets that connects the board to the masts provide footspace that a rider can use to gain leverage to roll the board and steer the watercraft.

A large sweep angle, e.g., 117*a* and 117*b*, makes it easier to balance and control foils with large wingspan. Larger sweep angles tend to reduce the roll inertia of the wing while increasing the roll damping, add yaw stability without yaw inertia, and generally make it easier to balance when standing on the board as it flies over the water.

The hydrofoil wing may have a longer chord length in inboard regions, e.g., 115, relative to outboard regions of the wing. Wings with a small chord at the wingtips 118*a* and 118*b* reduce roll inertia, making it easier to control a large foil using weight shift. It also makes breaching a wingtip more benign.

Uses of singular terms such as "a," "an," are intended to cover both the singular and the plural, unless otherwise indicated herein or clearly contradicted by context. The terms "comprising," "having," "including," and "containing" are to be construed as open-ended terms. It is intended that the phrase "at least one of" as used herein be interpreted in the disjunctive sense. For example, the phrase "at least one of A and B" is intended to encompass A, B, or both A and B.

While there have been illustrated and described particular embodiments of the present invention, those skilled in the art will recognize that a wide variety of modifications, alterations, and combinations can be made with respect to the above described embodiments without departing from the scope of the invention, and that such modifications, alterations, and combinations are to be viewed as being within the ambit of the inventive concept.

What is claimed is:

1. A hydrofoiling watercraft comprising:

a board having a right side, a left side, and a top surface for supporting a user;

a right mast extending downwardly from the right side of the board;

a right fuselage mounted to an outboard end of the right mast, wherein a forward portion of the right fuselage extends toward a direction of travel for the watercraft and a rearward portion of the right fuselage extends opposite the forward portion;

a left mast extending downwardly from the left side of the board;

a left fuselage mounted to an outboard end of the left mast, wherein a forward portion of the left fuselage extends toward a direction of travel for the watercraft and a rearward portion of the left fuselage extends opposite the forward portion;

a hydrofoil wing mounted to the forward portion of the right fuselage and the forward portion of the left fuselage; and a tail wing mounted to the rearward portion of the right fuselage and the rearward portion of the left fuselage, wherein the board further comprises:

a flotation portion having a right side and a left side;

a right winglet extending between the right mast and the right side of the board; and a left winglet extending between the left mast and the left side of the board.

2. The hydrofoiling watercraft of claim 1, wherein:

the right mast is rigidly connected to the right side of the board;

the right fuselage is rigidly connected to the right mast;

the left mast is rigidly connected to the left side of the board;

the left fuselage is rigidly connected to the left mast; and the hydrofoil wing is rigidly connected to the right fuselage and the left fuselage.

3. The hydrofoiling watercraft of claim 1, wherein the hydrofoil wing further comprises:

a right side portion extending outwardly from the right mast, a left side portion extending outwardly from the left mast, and wherein the right side portion and the left side portion both sweep rearwardly away from the direction of travel for the watercraft.

4. The hydrofoiling watercraft of claim 1, wherein the hydrofoil wing further comprises:

a right side portion extending outwardly from the right mast, a left side portion extending outwardly from the left mast, and wherein the right side portion and the left side portion both angle downwardly away from the board.

5. The hydrofoiling watercraft of claim 4, wherein the hydrofoil wing further comprises:

a right-side wingtip portion including a portion of the hydrofoil wing outward from the right side portion;

a left-side wingtip portion including a portion of the hydrofoil wing outward from the left side portion; and wherein the right-side wingtip portion and the left-side wingtip portion both angle upwardly toward the board.

6. The hydrofoiling watercraft of claim 1, further comprising a removable flotation portion surrounding at least a portion of the board such that the removable flotation portion increases a displacement of the board and provides greater stability and flotation for the hydrofoiling watercraft.

7. The hydrofoiling watercraft of claim 6, wherein the removable flotation portion is inflatable with a gas.

8. The hydrofoiling watercraft of claim 1, wherein the hydrofoil wing comprises a cross-section having a concave lower surface and a downward-sloped trailing edge.

9. A hydrofoiling watercraft comprising:

board having a top surface for supporting a user and a bottom surface;

a plurality of masts extending downwardly from the bottom surface of the board;

a plurality of fuselages having a forward portion extending toward a direction of travel for the watercraft and a rearward portion extending opposite the forward portion, wherein individual fuselages are rigidly mounted to an outboard end of a respective one of the plurality of masts;

a hydrofoil wing rigidly mounted to the plurality of fuselages at the forward portion of each respective one of the plurality of fuselages; and a tail wing rigidly mounted to the plurality of fuselages at the rearward portion of each respective one of the plurality of fuselages, wherein the hydrofoil wing comprises a cross-section having a concave lower surface and a downward-sloped trailing edge.

10. The hydrofoiling watercraft of claim 9, wherein the hydrofoil wing further comprises:

two side portions extending outwardly from outermost ones of the plurality of masts, wherein the side portions sweep rearwardly away from the direction of travel for the watercraft.

11. The hydrofoiling watercraft of claim 9, wherein the hydrofoil wing further comprises:

two side portions extending outwardly from outermost ones of the plurality of masts, wherein the side portions each angle downwardly away from the board.

12. The hydrofoiling watercraft of claim 9, wherein the board further comprises:

a flotation portion having a right side and a left side;

a right winglet extending outwardly from the right side of the flotation portion; and a left winglet extending outwardly from the left side of the flotation portion;

wherein a first one of the plurality of masts extends downwardly from the right winglet and a second one of the plurality of masts extends downwardly from the left winglet.

13. The hydrofoiling watercraft of claim 9, wherein the hydrofoil wing comprises two side portions extending outwardly from outermost ones of the plurality of masts.

14. A hydrofoiling watercraft comprising:

a board having a right side, a left side, a bottom surface, and a top surface for supporting a user;

a right mast extending downwardly from the right side of the board;

a left mast extending downwardly from the left side of the board;

a hydrofoil wing comprising:

a first wing portion extending substantially between the right mast and the left mast;

a right side wing portion extending outwardly from the right mast; and a left side wing portion extending outwardly from the left mast;

wherein the right side wing portion and the left side wing portion both sweep rearwardly away from a direction of travel for the watercraft;

a center mast extending downwardly from the bottom surface of the board, wherein the hydrofoil wing is rigidly mounted to the center mast;

a fuselage portion of the right mast, extending forwardly toward a direction of travel for the watercraft; and a fuselage portion of the left mast, extending forwardly toward a direction of travel for the watercraft;

wherein the hydrofoil wing is rigidly mounted to the fuselage portion of the right mast and the fuselage portion of the left mast.

15. The hydrofoiling watercraft of claim 14, wherein the board further comprises:

a flotation portion having a right side and a left side;

a right winglet extending between the right side of the flotation portion and the right side of the board; and a left winglet extending between the left side of the flotation portion and the left side of the board.

16. The hydrofoiling watercraft of claim 14, wherein the right side wing portion and the left side wing portion both angle downwardly away from the board.

17. The hydrofoiling watercraft of claim 14, wherein the first wing portion, the right side wing portion, and the left side wing portion each comprise a cross-section having a concave lower surface and a downward-sloped trailing edge.

* * * * *